US007290361B2

(12) United States Patent
Liao

(10) Patent No.: US 7,290,361 B2
(45) Date of Patent: Nov. 6, 2007

(54) CONTAINER CAP WITH MOVABLE DECORATION PIECES

(76) Inventor: Chiu-Li Liao, No.92, Chonglun N. St., South District, Taichung City 402 (TW)

( * ) Notice: Subject to any disclaimer, the term of this patent is extended or adjusted under 35 U.S.C. 154(b) by 0 days.

(21) Appl. No.: 11/507,434

(22) Filed: Aug. 22, 2006

(65) Prior Publication Data

US 2007/0089341 A1 Apr. 26, 2007

(30) Foreign Application Priority Data

Oct. 19, 2005 (TW) ..... 94218085 U

(51) Int. Cl.
*G09F 19/00* (2006.01)

(52) U.S. Cl. ..... 40/409; 40/311; 220/376; D7/619.2

(58) Field of Classification Search ..... 40/324, 40/306, 311, 409, 410, 310; 446/74; 215/230; 220/376, 377; D7/619.2
See application file for complete search history.

(56) References Cited

U.S. PATENT DOCUMENTS 2,766,796 A * 10/1956 Tupper ..... 220/521
3,531,635 A * 9/1970 Hancock ..... 362/101
5,156,550 A * 10/1992 Alexander ..... 434/370
5,167,993 A * 12/1992 Aoyagi ..... 428/34
6,027,774 A * 2/2000 Fine et al. ..... 428/14
6,105,819 A * 8/2000 Ho et al. ..... 222/78
6,380,926 B1 * 4/2002 Ho ..... 345/163

* cited by examiner

*Primary Examiner*—Gary C. Hoge
(74) *Attorney, Agent, or Firm*—Rosenberg, Klein & Lee

(57) ABSTRACT

A decorative container assembly includes a container and a cap is removably connected to either one of two ends of the container. The cap has an enclosed space defined therein and a combination liquid is received in the enclosed space. The combination liquid includes a first liquid, a second liquid and decoration pieces. The two respective specific weights of the first and second liquids are different so that when the container is filed with a third liquid which transfers its temperature to the combination liquid and the decoration pieces are movable in the combination liquid.

7 Claims, 7 Drawing Sheets

CONTAINER CAP WITH MOVABLE DECORATION PIECES

FIELD OF THE INVENTION

The present invention relates to a cap for a container such as a cup, and the cap has movable decoration pieces received therein.

BACKGROUND OF THE INVENTION

A conventional decoration member 6 is shown in FIG. 6 and generally includes a transparent body with a space defined therein and decoration pieces 61 are received in the space. FIG. 7 shows a decoration cup 7 which has space defined between an inner wall 72 and an outer wall 73. A decoration liquid 71 is received in the space between the inner wall 72 and the outer wall 73. However, users have to shake the cup 7 that the decoration liquid 71 flows within the space. Once there is no such an exterior force applied to the cup 7, the decoration liquid 71 is stationary and cannot display a vivid and movable decoration feature.

The present invention intends to provide a decoration cap for a container and the cup can be easily connected with the container and a combination of liquid is filed in the space in the cap. A plurality of decoration pieces are in the combination of liquid and the decoration pieces are movable due to change of temperature.

SUMMARY OF THE INVENTION

The present invention relates to a decorative container assembly that comprises a container having a connection portion connected to at least one of a first end and a second end thereof. A cap is removably connected to the container by the connection portion and has an enclosed space defined therein. A combination liquid is received in the enclosed space and includes a first liquid, a second liquid and decoration pieces, wherein the second liquid has a specific weight which is larger than a specific weight of the first liquid. The decoration pieces move in the combination liquid when a third liquid in the container transfers its temperature to the combination liquid.

The primary object of the present invention is to provide a cap of a container wherein the cap has a combination liquid filled in the enclosed space in the cap and decoration pieces are movable in the combination liquid due to change of temperature.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
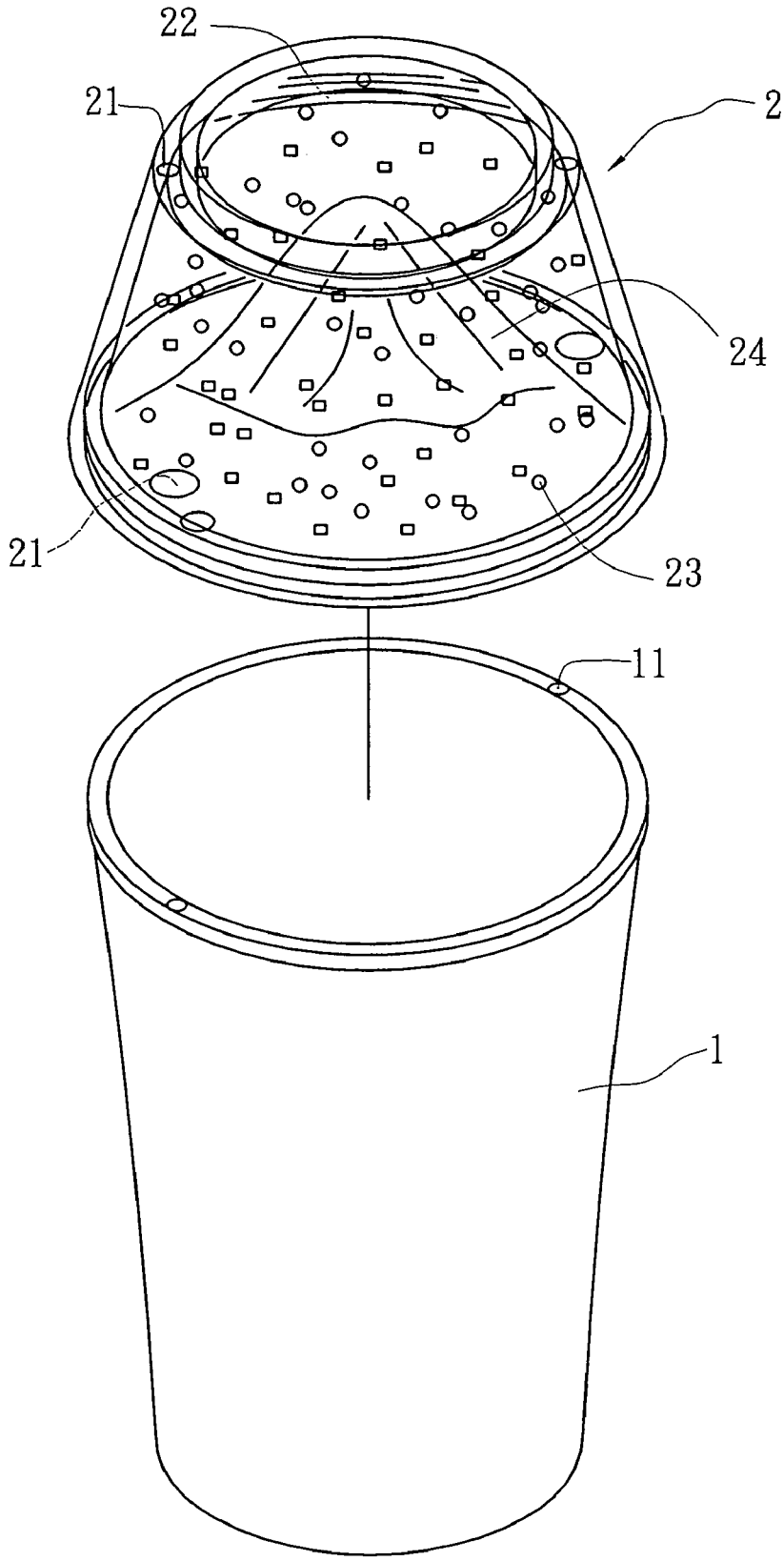
FIG. 1 is an exploded view to show the cap and the container of the container assembly of present invention.
Figure 2:
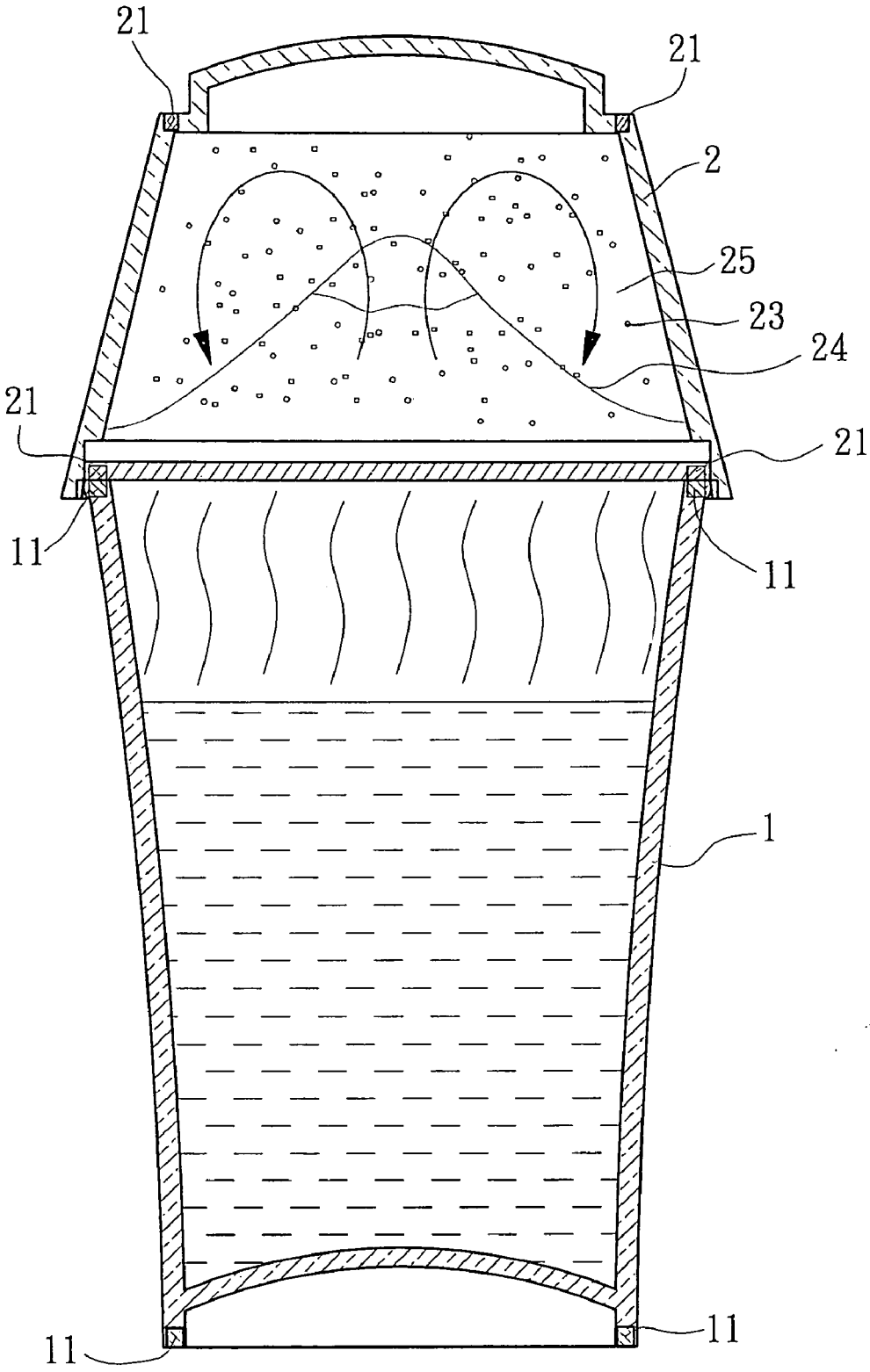
FIG. 2 is a cross sectional view of the container assembly of present invention, wherein the cap is connected to the first end of the container.

Referring to FIGS. 1 and 2, the decorative container assembly of the present invention comprises a container 1 having a connection portion 11 connected to each of the first end and the second end thereof, wherein the first end is an open end and the connection portion 11 is located at a periphery of the open end. The connection portion 11 of the container 1 includes first magnets.

A cap 2 for the container 1 has second magnets 21 connected to each of the first and second ends thereof. The second magnets 21 are magnetically attracted by the first magnets so that the cap 2 is removably connected to the container 1 by the connection portion 11. The cap 2 has an enclosed space 25 defined therein and a combination liquid 22 is received in the enclosed space 25. The combination liquid 22 includes a first liquid such as water, a second liquid such as alcohol-related liquid and-decoration pieces 23 which can be thin flakes. The second liquid has a specific weight which is larger than a specific weight of the first liquid. A decoration object 24 is located in the enclosed space 25 of the cap 2 so as to provide a 3-Dimension feature. The first liquid occupies about 80-90% of the volume of the combination liquid 22 and the second liquid occupies about 10-15% of the volume of the combination liquid 22.

As shown in FIG. 2, when the cap 2 is connected to the open end of the container 1 in which hot water is filled, the high temperature from the hot water is transferred to the combination liquid 22 in the cap 2 so that the second liquid first receives the heat so as to drive the decoration pieces 23 upward and when the decoration pieces 23 contact the water which has a specific weight smaller than-the specific weight of the decoration pieces 23, so that the decoration pieces 23 move downward. Therefore, the decoration pieces 23 move up and down in the combination liquid 22 due to the temperature. The first and second liquids may have different colors and the decoration pieces 23 may have reflective surfaces so that the moving decoration pieces 23 flash in the combination liquid 22.

Figure 3:
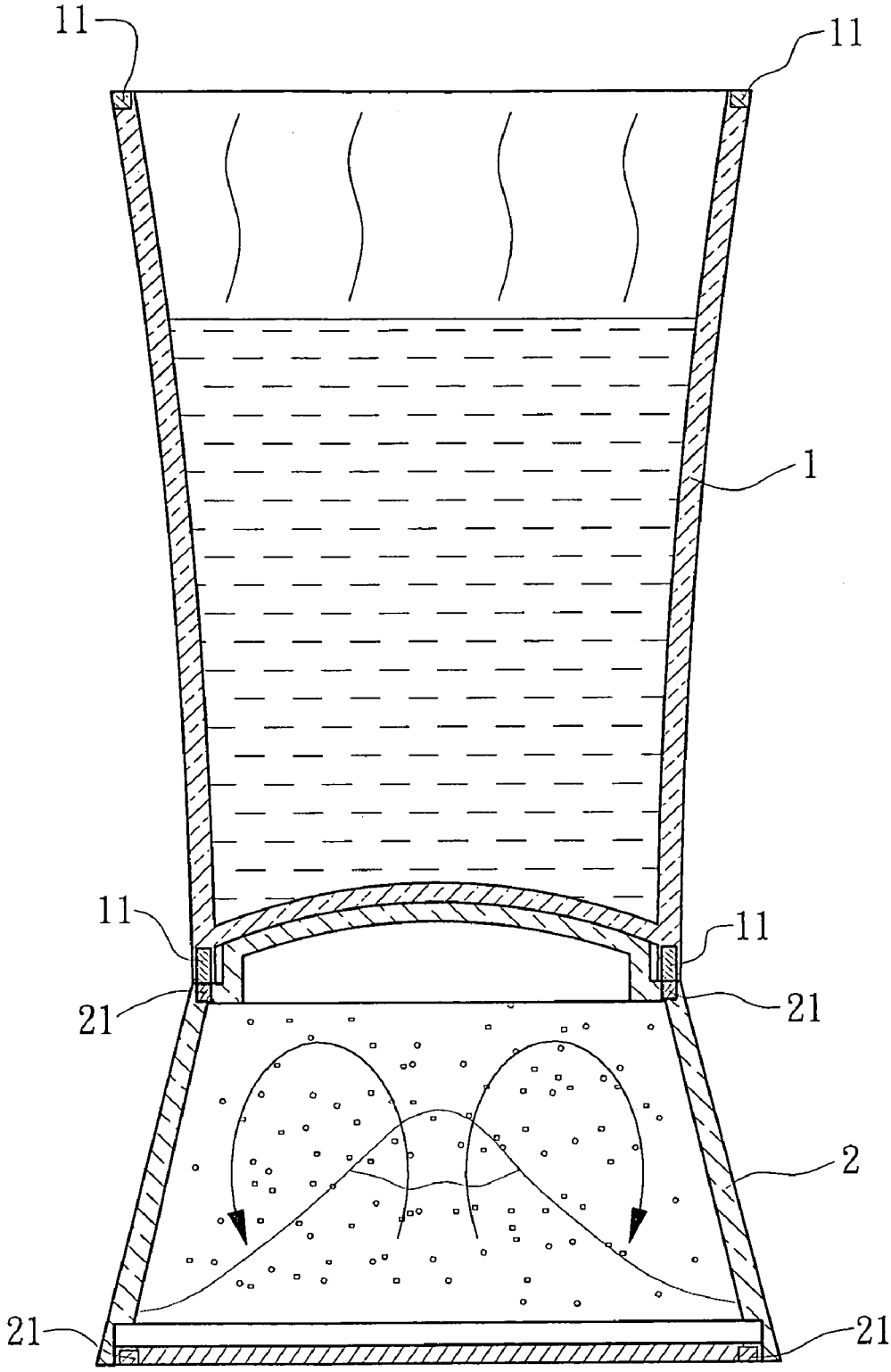
FIG. 3 is a cross sectional view of the container assembly of present invention, wherein the cap is connected to the second end of the container.

FIG. 3 shows the cap 2 is connected to the second end of the container 1 in which ice water is filled, and the combination liquid 22 in the cap 2 is higher than the ice water so that the decoration pieces 23 move upward till the decoration pieces 23 contact the first liquid and then move downward.

Some adding such as salt and active agent can be added in the combination liquid 22 so as to prolong the time that the decoration pieces 23 move between the first and second liquids.

Figure 4:
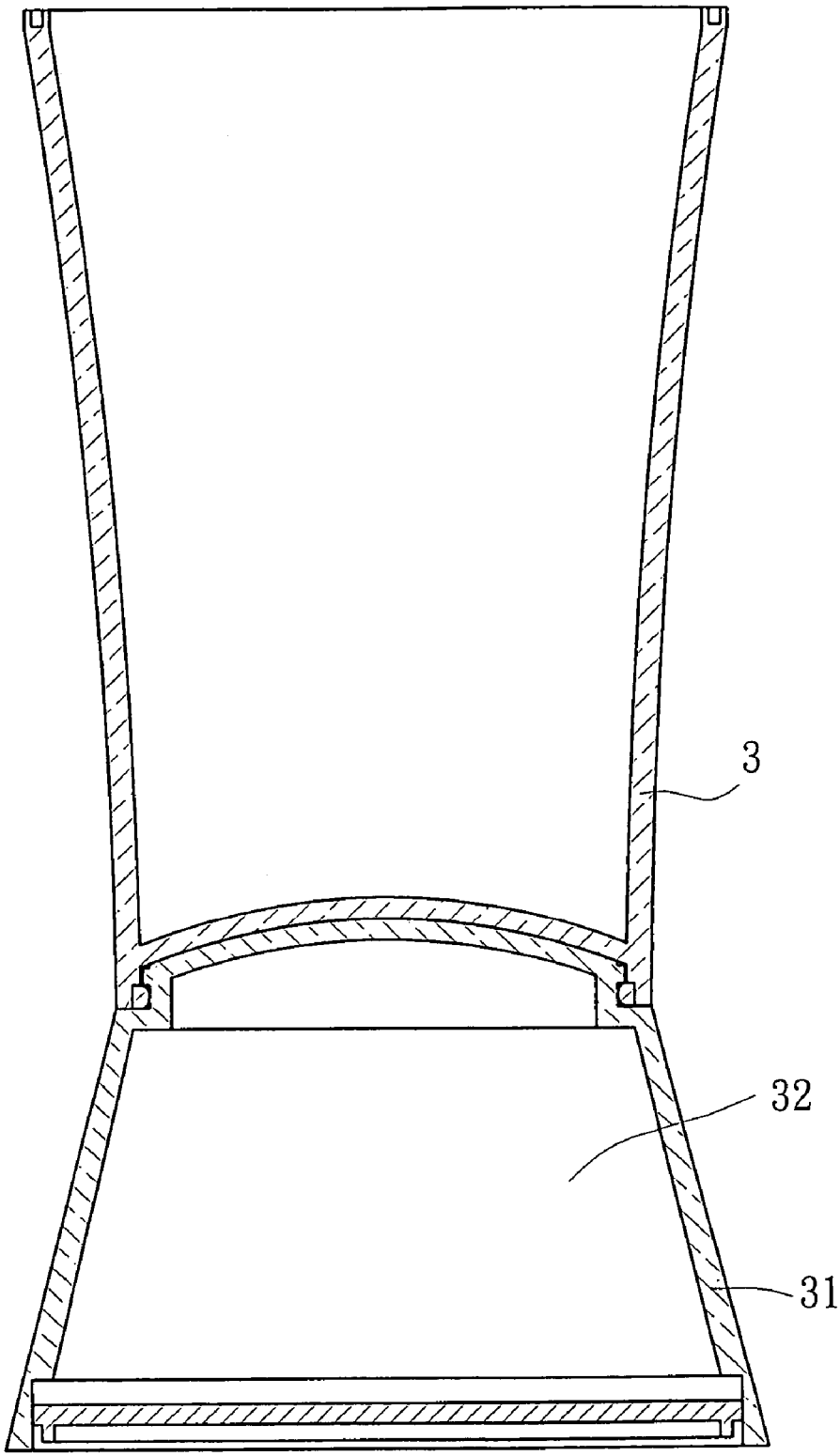
FIG. 4 shows another embodiment of the cap and the container of the container assembly of present invention.
Figure 5:
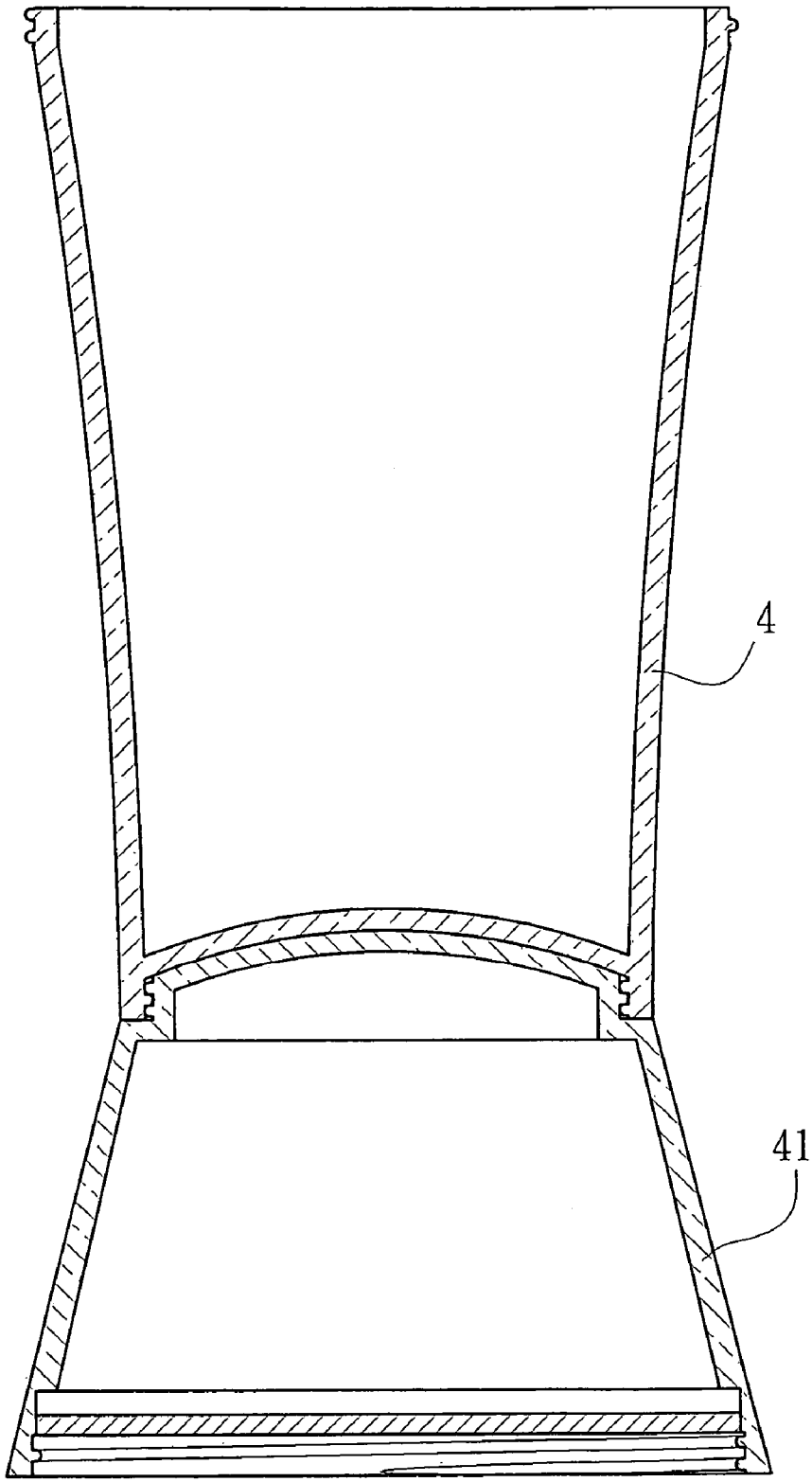
FIG. 5 shows yet another embodiment of the cap and the container of the container assembly of present invention.
Figure 6:
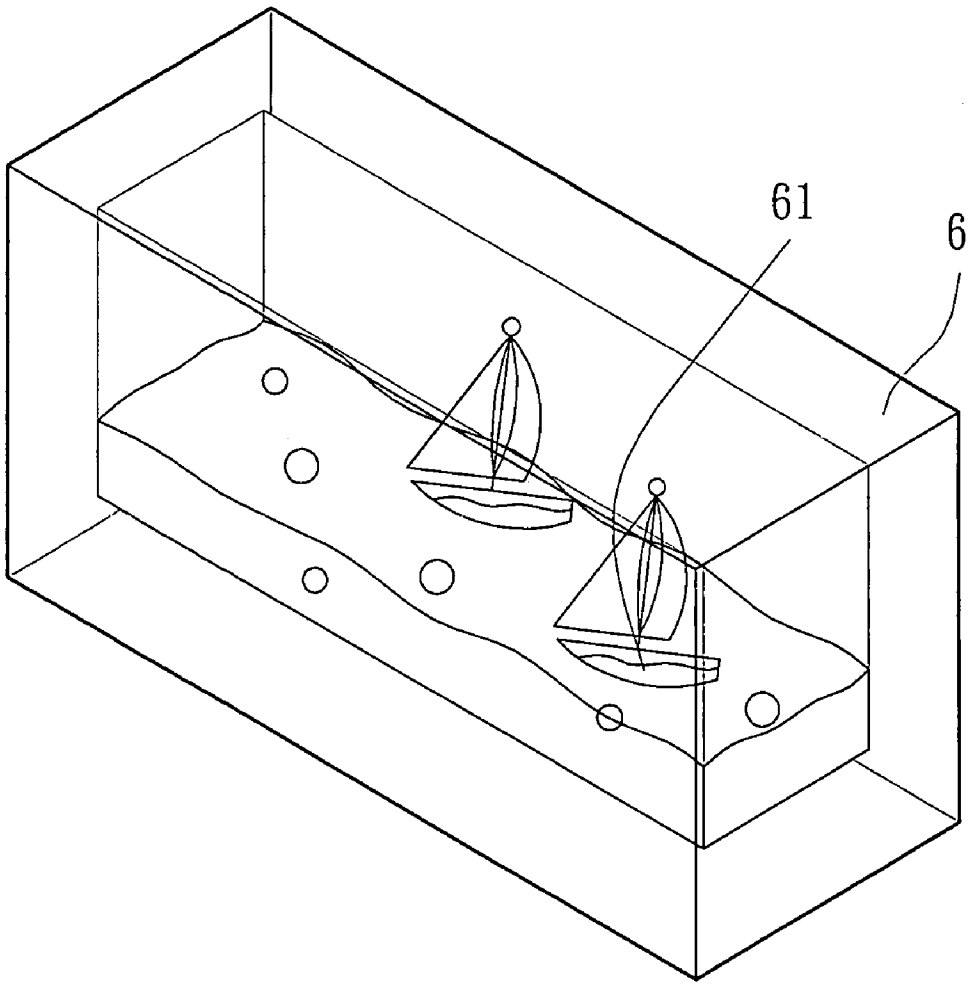
FIG. 6 PRIOR ART
FIG. 6 shows a conventional decoration member.
Figure 7:
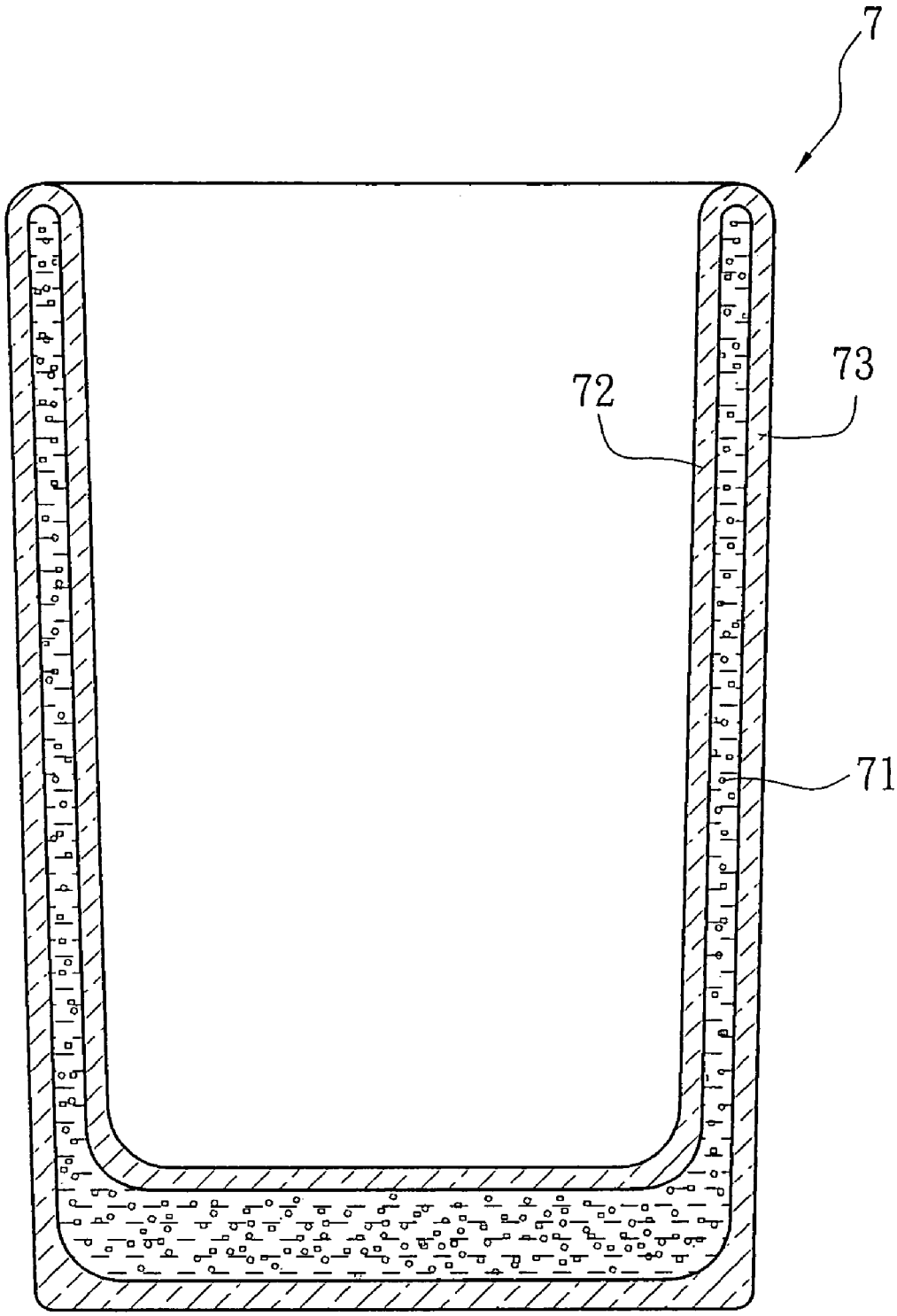
FIG. 7 PRIOR ART
FIG. 7 shows a conventional decoration cup.

FIG. 4 shows another embodiment of the cap 31 and the container 3 of the present invention wherein the connection portion for the container 3 is a groove 30 defined in an inner peripheral of a wall extending from the second end of the container 3 and the cap 31 has a flange 32 which is engaged with the groove 30. FIG. 5 shows yet another embodiment of the cap 41 and the container 4 of the present invention wherein the connection portion is a first thread 40 defined in an inner peripheral of a wall extending from the second end of the container 4 and the cap 41 has a second thread 42 which is engaged with the first thread 40.

While we have shown and described the embodiment in accordance with the present invention, it should be clear to those skilled in the art that further embodiments may be made without departing from the scope of the present invention.

What is claimed is:

1. A decorative container assembly comprising:

a container having a connection portion connected to at least one of a first end and a second end thereof, a cap removably connected to the container by the connection portion and having an enclosed space defined therein, a combination liquid received in the enclosed space, the combination liquid including a first liquid, a second liquid and decoration pieces, the second liquid having a specific weight which is greater than a specific weight of the first liquid, and the container defining a container chamber being at least partially filled with a liquid which is above or below a temperature of the first and second liquid for transferring heat to or from the container chamber to the cap space thereby displacing the decoration pieces within the cap space.

2. The assembly as claimed in claim 1, wherein the combination liquid has salt added therein.

3. The assembly as claimed in claim 1 further comprising a decoration object in the enclosed space of the cap.

4. The assembly as claimed in claim 1, wherein the decoration pieces are thin flakes.

5. The assembly as claimed in claim 1, wherein the connection portion of the container is first magnets and the cap has second magnets which are magnetically attracted by the first magnets.

6. The assembly as claimed in claim 1, wherein the connection portion is a groove defined in an inner peripheral of a wall extending from the second end of the container and the cap has a flange which is engaged with the groove.

7. The assembly as claimed in claim 1, wherein the connection portion is a first thread defined in an inner peripheral of a wall extending from the second end of the container and the cap has a second thread which is engaged with the first thread.

* * * * *